US006048273A

United States Patent [19]

Clement

[11] Patent Number: 6,048,273

[45] Date of Patent: Apr. 11, 2000

[54] PUTTING STROKE TEACHING AID APPARATUS

[75] Inventor: Clint D. Clement, Ottumwa, Iowa

[73] Assignee: Pure Stroke, Inc., Ottumwa, Iowa

[21] Appl. No.: 09/078,780

[22] Filed: May 14, 1998

[51] Int. Cl.[7] ..... A63B 69/36

[52] U.S. Cl. ..... 473/261; 273/DIG. 21; 273/180; 273/195

[58] Field of Search ..... 473/257, 258, 473/260, 261, 264, 180, 195; 273/DIG. 21

[56] References Cited

U.S. PATENT DOCUMENTS

| | | | |
|---|---|---|---|
| 1,545,648 | 7/1925 | Fletcher . | |
| 2,095,062 | 10/1937 | Glancey | 473/146 |
| 2,869,875 | 1/1959 | Steenson | 273/DIG. 21 |
| 3,375,010 | 3/1968 | Panza | 473/264 |
| 3,604,711 | 9/1971 | Hansburg . | |
| 3,806,133 | 4/1974 | Cork . | |
| 4,093,233 | 6/1978 | Barbarow . | |
| 5,042,815 | 8/1991 | Sutton | 273/DIG. 21 |
| 5,209,484 | 5/1993 | Randall . | |
| 5,624,326 | 4/1997 | Hohl . | |
| 5,672,114 | 9/1997 | Tu . | |

*Primary Examiner*—George J. Marlo
*Attorney, Agent, or Firm*—Shook, Hardy & Bacon L.L.P.

[57] ABSTRACT

A putting stroke teaching aid apparatus includes a pair of standards that are separated from one another along a target line, a reel supported on one of the standards and a cord supported on the reel and movable between a retracted position wound on the reel and an extended position unwound from the reel. The reel is spring loaded to exert a retracting force on the cord such that slack in the cord is taken up by the reel when the cord is extended and secured in place in a pair of slots formed in the standards so that the cord can be aligned directly over the target line by adjusting the positions of the standards on the putting surface. At least one of the standards can be formed with a central cutout aligned vertically with the cord when the cord is supported on the standards, and a plurality of slots can be provided on each standard so that the cord can be supported parallel to the putting surface at different heights.

10 Claims, 1 Drawing Sheet

PUTTING STROKE TEACHING AID APPARATUS

STATEMENT REGARDING FEDERALLY SPONSORED RESEARCH OR DEVELOPMENT

Not applicable.

CROSS REFERENCE TO RELATED APPLICATIONS

Not applicable.

BACKGROUND OF THE INVENTION

The present invention relates generally to teaching aids for the sport of golf, and more particularly to an indoor/outdoor putting stroke teaching aid apparatus.

All golfers realize the importance putting plays in the game of golf, and recognize that many strokes can be saved during a round of golf by good putting. However, golfers of all levels of ability struggle, at least from time-to-time, with their putting stroke. As such, putting stroke teaching aid apparatuses have been proposed for assisting golfers of all abilities to improve their putting stroke.

For example, U.S. Pat. No. 5,624,326, shows an apparatus which provides three posts that are connected to one another by a cord suspended above the ground. The length of the cord is adjustable such that the distance between the posts can be changed to meet the golfer's needs, and it serves as an alignment guide for the golfer. Although this construction works well on an outdoor putting green, it has no utility indoors because the posts must be driven into the ground for support. Additionally, although the cord is utilized as an alignment guide for the golfer, it cannot be adjusted in height, and as such cannot be lowered into proximity to the putting surface to restrict upward lifting movement of a putter by the golfer during a putting stroke. The height to which a putter head is drawn during the back swing of a putting stroke is an important element of a good swing, and the conventional teaching aid apparatus is incapable of being adjusted in height to facilitate instruction of this element of the stroke. Further, the noted type of apparatus does not provide a cup-like structure, but rather must be used on a putting green with an actual cup.

An example of another known type of putting stroke teaching aid apparatus is shown in U.S. Pat. No. 2,869,875, wherein an apparatus has two U-shaped wickets that are positioned apart from one another with a cord stretched between the two wickets. The cord is contained on a reel, making the distance between the wickets adjustable. However, height adjustment of the cord is not possible, and the cord is attached to the side edges of the wickets such that the cord is offset laterally from the line along which a golf ball is to travel toward a target defined by the wickets. As such, the known type of apparatus does not allow a golfer to practice proper alignment by looking directly down onto both the cord and the target line, as would be desirable.

SUMMARY OF THE INVENTION

It is an object of the present invention to provide a putting stroke teaching aid apparatus adapted for both indoor and outdoor use, wherein a cord is aligned directly over a target line to facilitate proper set up and putting of a golf ball along the line.

Another object of the invention is to provide a putting stroke teaching aid apparatus which provides at least one standard presenting a cutout centrally aligned with the cord, wherein the cutout is of a width corresponding to the diameter of a U.S.G.A. regulation cup.

A further object of the invention is to provide a putting stroke teaching aid apparatus having a cord that is adjustable both vertically and horizontally relative to a putting surface in order to facilitate its use to both indicate the line of a putt and restrict the height to which a putter is raised during a putting stroke.

In accordance with these and additional objects, advantages, and novel features of the invention apparent to those skilled in the art, the invention is drawn to a putting stroke teaching aid apparatus for use on a putting surface presenting a target line. The apparatus includes a pair of self-supported standards, each having a base and an upstanding stem including at least one slot formed therein at a predetermined height above the base. A reel is supported on one of the standards, and a cord is wound on the reel and is movable between retracted and extended positions. The reel is spring loaded to exert a retracting force on the cord such that slack in the cord is taken up by the reel when the cord is extended, and the cord is sized for receipt in the slots of the standards so that the cord is fixed at the predetermined height and can be aligned directly over the target line by adjusting the positions of the standards on the putting surface.

By providing a putting stroke teaching aid apparatus in accordance with the present invention, numerous advantages are realized. For example, by providing standards that position a cord directly over a target line, it is possible for a golfer to set up properly over the line, and to "see" where the ball will go if properly struck. In accordance with one aspect of the invention, at least one of the standards includes a central cutout having a width of 4.25 inches, and the cutout presents a center axis aligned vertically with the cord when the cord is supported in the at least one slots of the first and second standards. As such, the cutout simulates a regulation cup, allowing for the golfer to use the cup-sized cutout as a target lying directly beneath the cord in vertical alignment therewith.

Preferably, the standards are each provided with a plurality of slots that are spaced vertically from one another such that the cord can be supported parallel to the putting surface at different heights. This feature of the invention allows the cord to serve not only as an indicator of the target line along which the golf ball is to roll when properly struck, but also as a restriction to excessive lifting of the putter head during a stroke. Thus, a dual function is achieved by the combination presented by the inventive apparatus.

Another feature of the present invention resides in the use of weighted bases that protrude from the standards in a direction away from one another so that the center of gravity of each standard is spaced from the stem toward an outer side of the standard. As such, the area between the standards is free of obstructions, and each standard is able to remain balanced on the putting surface when the cord is pulled, e.g. when a golfer raises his or her putter against the cord during a putting stroke. In addition, the counterbalanced construction resists the pulling force exerted on the standards by the cord as it is biased toward the retracted position by the spring loaded reel.

BRIEF DESCRIPTION OF THE SEVERAL VIEWS OF THE DRAWING

A preferred embodiment of the invention is described below with reference to the attached drawing, wherein.

DETAILED DESCRIPTION OF THE INVENTION

Figure 1:
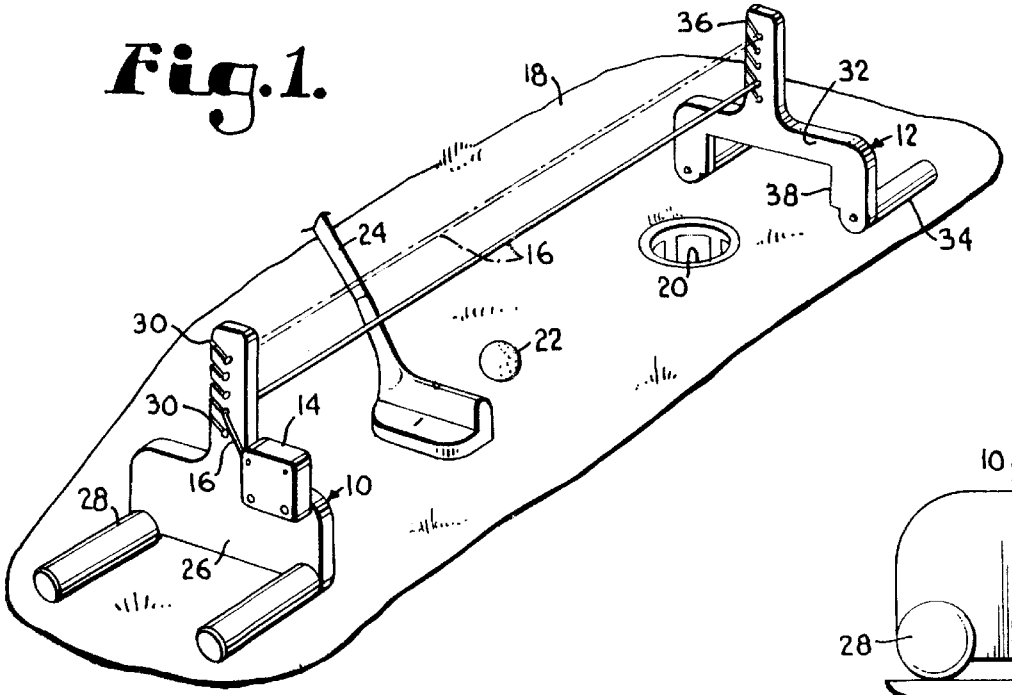
FIG. 1 is a perspective view of a putting stroke teaching aid apparatus constructed in accordance with the preferred embodiment.

Referring to FIG. 1, a putting stroke teaching aid apparatus constructed in accordance with the preferred embodiment of the present invention includes a pair of standards 10, 12, a reel 14 secured to the first standard 10, and an alignment cord 16 supported on the reel and movable between a retracted position wound on the reel and an extended position unwound from the reel. Also shown in FIG. 1 is an indoor or outdoor putting surface 18 that may or may not be provided with a cup 20, a golf ball 22 that is to be putted along a target line defined on the surface, and a putter 24.

The first standard 10 includes a body 26 and a pair of weighted feet 28, all of which are preferably formed of wood, plastic, metal, or any other rigid material. The body 26 is preferably formed from a generally flat plate, and includes a lower portion secured to the feet, and an upper portion presenting an upstanding stem. The feet 28 define a base of the standard, and protrude outwardly from the standard away from the opposing standard 12. As such, the inner face of the body closest to the standard 12 is generally flat, and does not present any obstructions that might otherwise interfere with a putting stroke. The feet 28 are preferably threaded into the body 26 such that they are removable for shipping and storage. However, the feet and body may be formed integrally, if desired.

By constructing the body 26 from a plate, and by providing the feet on the outer side of the body, a construction results in which the center of gravity of the standard 10 is displaced outwardly from the body thereof. As such, any forces exerted on the standard that might otherwise tip the standard inward toward the other standard are resisted. For example, if the putter 24 is raised into contact with the alignment cord 16 during a putting stroke, pulling on the cord, the counterbalanced design of the standard would resist tipping of the standard. In addition, the counter weighted construction facilitates indoor use of the apparatus when it is not possible to employ spikes or the like to secure the standards in place on a putting green.

Figure 3:
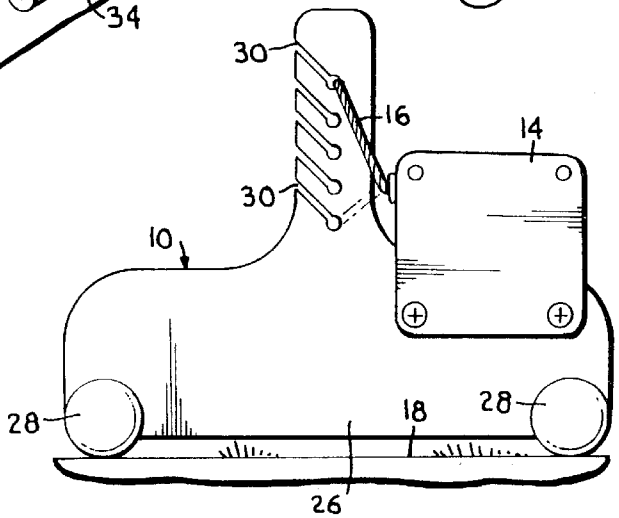
FIG. 3 is an end elevational view of a first standard forming a part of the apparatus.

As shown in FIG. 3, the stem of the standard 10 is centrally located on the body between the feet 28, and includes a plurality of slots or notches 30 that are disposed at a predetermined spacing from one another. The slots all extend into the stem from the same side of the standard, and each slot presents an inner end that is preferably aligned with the center of the standard so that the cord 16 is supported centrally between the feet during use.

Returning to FIG. 1, the second standard 12 includes a body 32 and a pair of weighted feet 34, both of which are preferably formed of the same material as the first standard 10. The body 32 is preferably formed from a generally flat plate, and includes a lower portion secured to the feet, and an upper portion presenting an upstanding stem. The feet 34 define a base of the standard, and protrude outwardly from the standard away from the opposing standard 10. As such, the inner face of the body closest to the other standard is generally flat, and does not present any obstructions that might otherwise interfere with a putting stroke. The feet 34 are preferably threaded into the body of the standard such that they are removable for shipping and storage. However, the feet and body may be formed integrally, if desired.

By constructing the body of the standard 12 from a plate, and by providing the feet 34 on the outer side of the body, a construction results in which the center of gravity of the standard is displaced outwardly from the body thereof. As such, any forces exerted on the standard that might otherwise tip the standard inward toward the other standard are resisted. In addition, the counter weighted construction facilitates indoor use of the apparatus.

The stem of the standard 12 is centrally located on the body between the feet, and includes a plurality of slots or notches 36 that are disposed at a predetermined spacing corresponding in heights to the heights of the slots 30 in standard 10. The slots all extend into the stem from the same side of the standard, and each slot presents an inner end that is preferably aligned with the center of the standard defined by a cutout 38 in the body.

The cutout 38 extends upward from the bottom edge of the base toward the stem, and preferably is of a width of about 4.25 inches to approximate the diameter of a regulation golf cup. The cutout 38 defines a center line that is aligned in the same vertical plane as the inner ends of the slots 36 so that the cord 16 is supported within the same vertical plane as the center of the "cup" defined by the cutout. By aligning the cord and the center of the cutout in the same vertical plane, it is possible to align the cord directly over the ball 22 and the target line passing between the ball and the cutout such that a clear visual indication of the target line can be perceived by a golfer. In addition, by aligning the cord and the cutout in this manner, the cord is positioned between the target line and the golfer so that the golfer must line up to the line with his or her eyes disposed in the same vertical plane as the cord and the target line. Thus, proper set up to the ball and the target line is taught.

Although the preferred embodiment includes a cutout sized to match the size of a regulation cup, it may be made of any desired dimension adapted to facilitate use of the apparatus. Alternately, it is possible to provide a template, separate from the standard, which can be positioned against the body 32 over the cutout 38, and which presents its own cutout that is smaller than the cutout in the standard. For example, the template may be a flat metal plate adapted to be secured to the body of the standard over the cutout, and presenting a pair of mounting holes by which the template is secured to the body 32 by the feet 34. Thus, the template can be sandwiched between the feet and the body, and is retained in position over the cutout to define a smaller cutout that forces the golfer to exhibit greater accuracy than would be required to putt a ball through the larger, regulation-sized cutout of the body 32. Several templates presenting cutouts of varying sizes may be provided to permit the cup sized to be adjusted in accordance with the skill of the golfer.

The reel 14 is fixably attached to the outer side of the body of the first standard 10 by any suitable means, and preferably is a conventional spring-loaded reel that is fastened to the standard by threaded fasteners. However, other types of reels or spools may be employed without departing from the scope of the present invention so long as the reel exerts a biasing force on the alignment cord that takes up the slack in the cord when it is positioned between the two standards 10, 12. Although fasteners are preferred for securing the reel in place, other mechanical expedients or a suitable adhesive could also be used.

Figure 2:
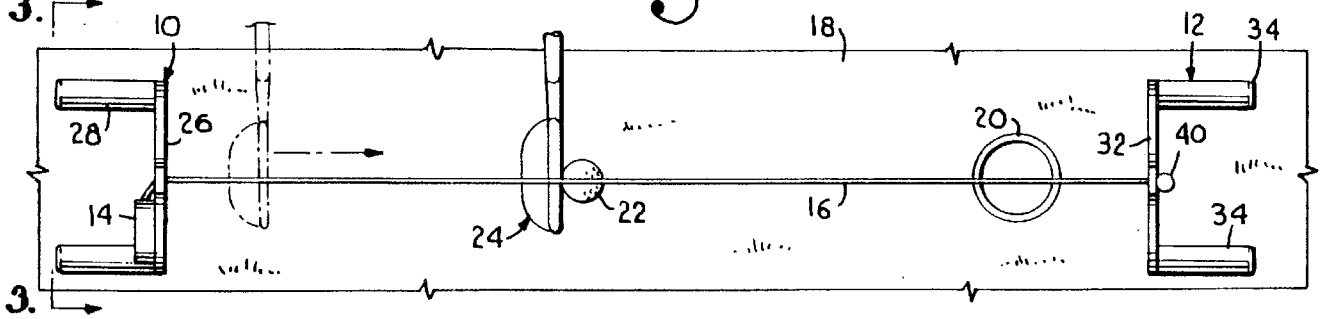
FIG. 2 is a top view of the apparatus, illustrating the manner in which the apparatus is used during a putting stroke.

The alignment cord 16 can be made of any flaccid length of string, cord or filament that is capable of being easily wound on the reel 14. In the preferred embodiment, the alignment cord 16 is string. In order to secure the alignment cord 16 to second standard 12 during use, an end element 40, shown in FIG. 2, is tied or otherwise affixed to the free end of the cord 16. The end element 40 is sized larger than the size of the slots 36 in the standard 12 so that it retains the cord strung between the standards during use, and prevents the alignment cord 16 from being retracted into reel 14 so long as the cord is suspended between the standards. In the preferred embodiment, the end element is a metal loop tied to the end of the alignment cord 16.

In order to use the apparatus as a putting stroke teaching aid, a golfer positions the standards 10, 12 on a flat indoor or outdoor putting surface with the inner sides of the standards facing one another and with the feet 28, 34 facing outward. In this orientation, the feet counterbalance the standards to prevent them from tipping inward, and are out of the area between the standards where the stroke is to be practiced.

The distance between the standards is selected based on the distance of the putts to be practiced, and the cord 16 is extended by an amount sufficient to enable it to be secured to both standards. The cord is held in place on the standards by training the cord into one of the slots 30, 36 of each standard and releasing the cord so that the end element 40 engages the second standard 12. The biasing force of the reel 14 then exerts a retracting force on the cord that takes up the slack in the cord, holding it substantially parallel to the ground.

Because the slots 30, 36 are at an equal height to one another, the cord is oriented parallel to the putting surface and can be used to restrict the height to which the putter is raised above the surface during a stroke. By selecting the lowest slots on the standards, the height is adjusted down to prevent the putter from coming any higher than is required to hit relatively short putts, and the higher slots position the cord at a height which restricts the putter only when longer strokes are made.

Once the apparatus is set up, the golfer places the golf ball 22 on the putting surface 18 directly under alignment cord 16 such that the target line, the ball 22, and the cord 16 are all disposed in a common vertical plane. Then, using the putter 24, the golfer makes a putting stroke, keeping the putter substantially parallel to and beneath the alignment cord 16, striking the golf ball 22. If it is struck properly, and the target line is level, the golf ball will travel directly under alignment cord 16 until it passes through the "cup" defined by the cutout 38. The positioning of the golf ball 22 directly under the alignment cord 16 is important to the development of good putting skills. This allows a golfer to develop a consistent stance with his eyes directly over the golf ball.

Additionally, the alignment cord 16 is attached at a position in the center of the cutout 38 to ensure a real putting situation, whereby, on a level surface, the properly struck golf ball 22 will travel in a plane directly under the alignment cord and go through the cutout. This simulation allows a golfer to visualize and become comfortable with his/her stroke in an environment similar to actual putting.

In an outdoor setting the standards can be positioned on either side of an actual cup 20 formed in the surface 18, and aligned with a target line extending between a ball position and the cup such that the cord 16 is disposed in the same vertical plane as the target line and the center of the cup 20. Thus, the golfer can use the apparatus in putting balls into actual cups on a putting green or the like.

Where, in an outdoor setting, the putting surface is sloped such that a properly struck ball will follow a curved or arcuate path to the cup, the apparatus is set up so that the standards are positioned on either side of the initial target line along which the ball should be struck in order to finish at the cup. As such, the cord is disposed in the same vertical plane as the initial target line at the center of the ball, enabling the golfer to line up directly over the ball and see the target line along which the ball should be struck in order to obtain a desirable result. Thus, in all instances of use, the apparatus is set up in order to provide a visual indication of the initial line along which a golf ball is to be putted so that a golfer can set up to and strike the ball properly. In addition, the height of the cord is adjusted for the distance of the putt to be practiced so that the cord restricts lifting of the putter head above a pre-determined height during the stroke, providing instructional guidance as to the path of the stroke.

Although the invention has been described with reference to the preferred embodiment illustrated in the drawing figures, it is understood that equivalents may be employed and substitutions made herein without departing from the scope of the invention as recited in the claims.

I claim:

1. A putting stroke teaching aid apparatus for use on a putting surface comprising:

a first self-supported standard presenting a bottom surface and including at least one slot formed at a predetermined height above the bottom surface, the first standard including a cutout extending upward from the bottom surface, the cutout defining a center point along the width thereof;

a second self-supporting standard presenting a bottom surface and including at least one slot formed at a predetermined height above the bottom surface; and a cord supported in the at least one slots of the first and second standards so that the cord is fixed at the predetermined height above the bottom surfaces of the standards, the cord being disposed in a vertical plane that includes the center point of the cutout.

2. A putting stroke teaching aid apparatus as recited in claim 1, wherein the cutout has a width of 4.25 inches.

3. A putting stroke teaching aid apparatus as recited in claim 1, wherein the first and second standards each include a plurality of slots that are spaced vertically from one another, the slots in the first standard being disposed at the same heights as the slots in the second standard.

4. A putting stroke teaching aid apparatus as recited in claim 1, wherein the first and second standards present inner sides adapted to face one another, outer sides adapted to face away from one another, and a base that protrudes from the outer side of the standard so that the center of gravity of the standard is closer to the outer side of the standard than to the inner side.

5. A putting stroke teaching aid apparatus as claimed in claim 4, wherein the base of each standard is removable.

6. A putting stroke teaching aid apparatus as claimed in claim 4, wherein the bases of the first and second standards include counterweights that are screwed into the outer sides of the first and second standards.

7. A putting stroke teaching aid apparatus for use on a putting surface, comprising:

first and second standards presenting inner sides adapted to face one another and outer sides adapted to face away from one another, each of the standards including a weighted base protruding from the outer side of the standard so that the center of gravity of the standard is closer to the outer side of the standard than to the inner side, at least one of the standards including a bottom surface and a cutout that extends upward from the bottom surface between the inner and outer sides, the cutout having a width across the inner side of the standard that defines a center point; and a cord secured between the standards at a predetermined height, the cord being disposed in a vertical plane that includes the center point of the cutout.

8. A putting stroke teaching aid apparatus as claimed in claim 7, wherein the cutout has a width of 4.25 inches.

9. A putting stroke teaching aid apparatus as recited in claim 7, wherein the first and second standards each include a plurality of slots that are spaced vertically from one another, the slots in the first standard being disposed at the same heights as the slots in the second standard so that the cord can be supported parallel to the putting surface at different heights.

10. A putting stroke teaching aid apparatus as claimed in claim 7, wherein the base of each standard is removable.

* * * * *